United States Patent [19]

Clark

[11] 4,051,910

[45] Oct. 4, 1977

[54] TWO WAY EARTH BORING FLUID MOTOR

[76] Inventor: Wallace Clark, 1830 S. German Church Road, Indianapolis, Ind. 46239

[21] Appl. No.: 638,639

[22] Filed: Dec. 8, 1975

[51] Int. Cl.[2] ..... E21B 1/06

[52] U.S. Cl. ..... 175/103; 175/107; 175/97

[58] Field of Search ..... 175/101, 103, 107, 6, 175/97-99; 415/502; 418/48; 308/141, 142, 143

[56] References Cited

U.S. PATENT DOCUMENTS

| | | | |
|---|---|---|---|
| 3,112,801 | 12/1963 | Clark | 175/107 |
| 3,443,482 | 5/1969 | Lummus et al. | 418/48 |
| 3,603,407 | 9/1971 | Clark | 175/6 |
| 3,627,453 | 12/1971 | Clark | 418/48 |
| 3,840,080 | 10/1974 | Berryman | 175/107 |
| 3,844,690 | 10/1974 | Kopczynski | 418/48 |
| 3,951,097 | 4/1976 | Clark | 418/48 |

*Primary Examiner*—Ernest R. Purser
*Assistant Examiner*—Richard E. Favreau
*Attorney, Agent, or Firm*—Melville, Strasser, Foster & Hoffman

[57] ABSTRACT

There is disclosed a fluid motor composed of a helical gear pair wherein an inner chamber has an external helical thread and a cooperating outer member has one more internal helical thread than the number of external helical threads on the inner member. The outer member is secured to one of the sections of a water swivel which is conventional except that it has an axial intake, radial tube and inner member supporting guide, and means are associated with an end of the inner member and with the other section of the water swivel to prevent relative rotation between said inner and outer members while permitting gyration of the inner member in relation to the outer member. Each end of the device has a tapered female thread. The motor may be used either end up. A drill pipe or suitable sub is threaded into one end of the device and a tool is threaded into the other end of the device, directly or with the sub between. In one embodiment the outer member of the gear pair is held stationary by the drill pipe which is threaded into it or with a sub between, and the tool which is threaded into the other end is rotated by the rotation of the inner member and the rotating part of the water swivel. In another embodiment, the drill pipe is threaded into the stationary part of the water swivel or with a sub between and thus the inner element of the gear pair is held stationary and the outer element is caused to rotate with the rotating portion of the water swivel, and thus the tool is driven by the outer element of the gear pair. The tool is useful in earth boring as in well drilling, coring, mining, foundation settings, and substrata exploration.

9 Claims, 6 Drawing Figures

TWO WAY EARTH BORING FLUID MOTOR

CROSS REFERENCE TO RELATED APPLICATION

This application is related to a copending application in the name of Wallace Clark, Ser. No. 504,354, filed Sept. 9, 1974, now U.S. Pat. No. 3,932,072 dated Jan. 13, 1976 and an application in the name of Wallace Clark, Ser. No. 573,535 filed May 1, 1975, now U.S. Pat. No. 3,951,097 dated April 20, 1976.

BRIEF SUMMARY OF THE INVENTION

Said application Ser. No. 504,354 discloses a helical gear pair wherein the inner member has a radial arm nonrotatably secured at one of its ends and fixed means are provided to limit the other end of the radial arm to reciprocatory and oscillatory motion, so that the outer member is free to rotate on its true axis while the inner member gyrates with respect to the outer member. The disclosure in said application relates to a pump.

In said U.S. Pat. No. 3,951,097 there is disclosed a hydraulic motor or a pump, again utilizing a helical gear pair as above described and utilizing the radial member to permit gyration while preventing relative rotation between the inner and outer members, and said application discloses the use of water swivels. Either the inner or outer member, according to said last named application, may be caused to rotate, depending upon whether the radial element is secured to the rotating or to the stationary part of the water swivel. The device of said last named application may be used as a pump or as a motor and is disclosed in connection with marine propulsion. The water swivels used in that application are conventional in all principal respects, except for the radial tubes and inner member supporting guides.

According to the present invention, a water swivel is modified so as to have an axial inlet rather than a right angled inlet as is conventional in water swivels. Again the fluid motor of the present application comprises a helical gear pair wherein the inner member has an external helical thread and the cooperating outer member has one more internal helical thread than the number of external helical threads on the inner member. The basic helical gear pair elements are manufactured and sold by Robbins & Myers, Inc. under the trademark MOYNO.

The water swivel has two elements capable of relative rotation. In other words, one element of the water swivel may be held stationary while the other rotates, and vice versa. According to the present invention, the inner member is provided with means to prevent relative rotation between the inner and outer members while permitting gyration of the inner member, as described in said U.S. Pat. No. 3,932,072 and in one embodiment the ball cooperates with the rotation preventing element within a tube which is secured to such element of the water swivel, or it may, in another embodiment, cooperate within a tube in the rotating element of the water swivel, while the other, or fixed element of the water swivel and the other motor element are being prevented from rotation by the drill string. The outer member of the helical gear pair, which is generally of rubber or similar material, is secured to the other member of the water swivel.

Each end of the device is provided with a tapered internal thread so that either a sub or a section of drill pipe may be threaded into it or a tool, such as a drill bit or a coring tool, for example, may be threaded into it, directly or with a sub.

According to the present invention, the drill pipe can in all cases be held stationary. Thus, if the drill pipe is threaded into the end constituted by the water swivel and the tool is threaded into the other end, the inner element will be held stationary and the outer element, to which the tool is secured, will rotate.

If, on the other hand, the tool is threaded into the end constituted by the water swivel and the drill pipe or sub is threaded into the other end, then the outer element of the gear pair will be held stationary while the inner element gyrates and rotates and since it is connected by the ball and tube to the rotatable element of the water swivel, the tool will be rotated by the inner element of the pair.

Thus, there is provided a two way tool which may be used "either and up" with attendant advantages in each case, as will be pointed out in more detail hereinafter. The two different positions, however, require a change in hand of the motor element threads in order to maintain right hand threading in the entire drill string below the hanging water swivel in the drilling rig, from which the fluid comes, since the hanging water swivel conventionally is provided with a left hand thread.

The device of the present invention can be used by hanging it to the hook in the derrick of a conventional drilling rig and it could perform the function of what is commonly known as a "power swivel", with a torque arm, preferably telescoping, sliding up and down on a taut wire line. This will eliminate the use of a kelly and rotary table during drilling, except for the advisability of a pipe guide bushing in the table. It can be used with the rotating part of the table free to turn so that the kelly passing through the kelly bushing is rotated, and the table must be free to turn.

With means to prevent rotation in the hole, as disclosed in FIG. 10 of U.S. Pat. No. 3,603,407 in the name of Wallace Clark, the tool of the present invention may be suspended from a wire line connected to a powered reel and fluid may be supplied by means of a hose paid out from a hose reel, lengths at a time, thus substituting in a similar manner for pipe lengths. The tool may thus be used for light clean-out work and again it may be used "either end up". Similarly, the device may be used with the wire line reel and hose reel and rotation preventing device for drilling, coring, etc., as will be described in more detail hereinafter.

DETAILED DESCRIPTION

The early U.S. Pats. to R. J. L. Moineau, Nos. 1,892,217, 2,483,370 and others, disclose pumps made up of helical gear pairs. These early patents also disclose that the devices could be used as motors. In the operation of the helical gear pair, one of the pair is stationary and the other element rotates and gyrates. Thus, in order to transmit concentric rotation to a shaft or in order that the device may be driven by an electric motor, for example, which runs on true axes, a connecting rod and universal joints to be provided.

According to said U.S. Pat. No. 3,932,072, a radial arm having a ball on its end was secured to the inner member and the ball was capable of reciprocation in a tube attached to the other member. Thus, connecting rods and universal joints were eliminated and yet gyration and relative rotation was permitted. Reference may be had to said U.S. Pat. No. 3,932,072 for a detailed description of the relative rotation preventing means.

In said U.S. Pat. No. 3,951,097, it was disclosed how water swivels could be employed in connection with a hydraulic motor or pump. The water swivels there disclosed were conventional with radial water inlets. These water swivels comprise two relatively rotatable elements with suitable seals.

According to the present invention, a water swivel is modified to provide an axial inlet rather than a radial inlet and the inlet is provided with a tapered internal thread. The thread is such as to accommodate, for example, the threaded end of a section of drill pipe, directly or with a suitable sub, or a tool having a tapered male thread, directly or with a suitable sub.

Figure 1:
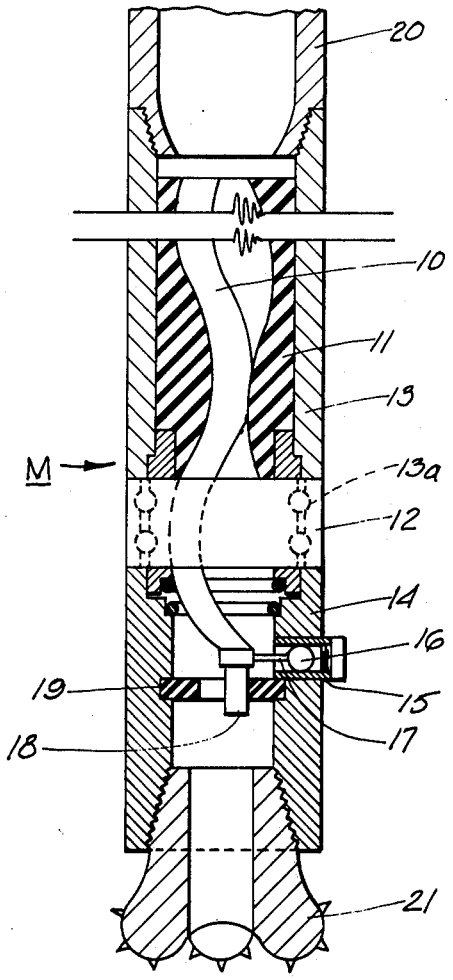
FIG. 1 is a cross sectional view of a tool according to the present invention in one mode of use.

Referring now in more detail to the drawings, and particularly FIG. 1, the gear pair comprises the inner member 10 and the outer member 11, with left hand threads. A water swivel is indicated generally at 12. The outer member 11 is fixed in the casing 13 and the lower end of the member 13 indicated in broken lines at 13*a* constitutes the fixed section of the water swivel 12. The rotating section of the water swivel is indicated at 14 and it is provided with the tube 15 in which the ball 16 may reciprocate. The ball 16 is secured on the end of an arm 17 fixed to the inner element 10. An extension 18 is provided on the end of the inner member 10 which operates within a supporting guide 19 which is of rubber or suitable resilient material. The function of the supporting guide is clearly described in said application Ser. No. 573,535, referred to therein as a damping ring.

In FIG. 1 a sub or a section of drill pipe is indicated at 20 and is threaded into the member 13. A tool 21 is threaded into the rotating portion of the water swivel 14.

If now the drill stem 20 is held stationary (as by being secured to a polygonal kelly passing through a nonrotatable kelly bushing) and a fluid such as, for example, drilling mud is pumped down through the drill stem 20 and through the fluid motor, the inner member 10 is caused to rotate and it carries with it the tool 21.

Figure 2:
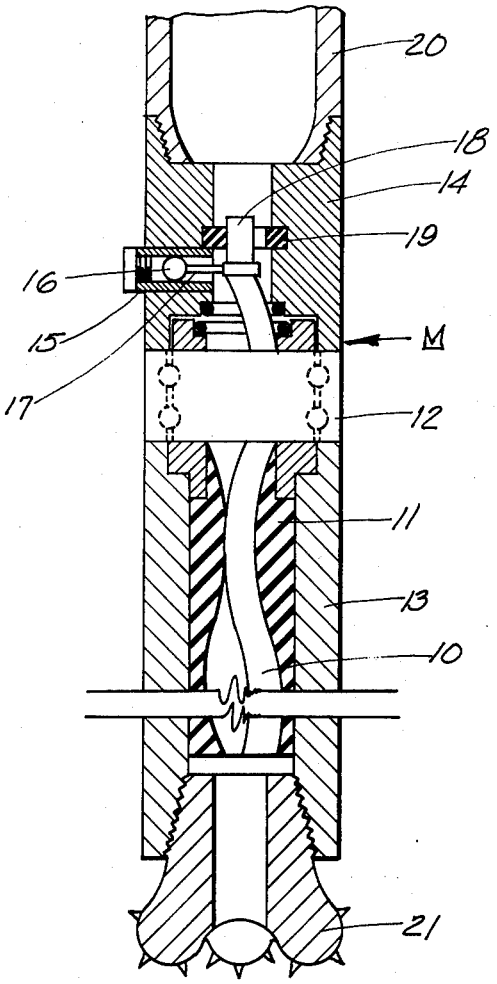
FIG. 2 is a view similar to FIG. 1 in an inverted mode of use.

In FIG. 2, the fluid motor of FIG. 1 is turned upside down, but with opposite threading of the elements to right hand, instead of the left hand threading of the elements in FIG. 1, and the drill stem or sub 20 is threaded into the section 14 while the tool 21 is threaded into the member 13. In this situation, when drilling mud is pumped down through the member 20, the member 14 is held against rotation and it therefore holds the inner member 10 against rotation while permitting it to gyrate and then the outer member 11 carrying with it the casing 13 and the tool 21 threaded thereinto rotates.

While it has been indicated above that the drill stem is held stationary, it is of course possible to permit it to rotate slowly in either direction which will assist in keeping the bore wall from becoming clogged or the mud on the walls channeled. Thus, slow rotation may be accomplished with the tool in the FIG. 1 configuration or in the FIG. 2 configuration. In this connection, reference may be had to U.S. Pat. No. 3,675,727 in the name of Wallace Clark. That patent describes how this slow rotation may be used to maintain optimum drilling rates and for protection from over-stress on the motor.

The motor of the present invention may be used for the drilling of shallow wells, the drilling of deep wells for water, oil or gas, for sampling of earth to determine geological or minerallogical data in connection therewith. While drilling practices are well understood, it may be desirable to very briefly outline conventional practice. As a matter of general practice, some sort of drill bit is secured to the lower end of a piece of drill pipe. A suitable rig is provided on the ground to hold the drill pipe in a vertical position and cause it to rotate. A drilling mud is pumped through the drill pipe and issues through the drill bit, washing away the particles of earth or rock produced by the drilling operation and flushing them to the surface through the annular space between the drill hole and the drill pipe.

As the hole becomes too deep for the particular piece of drill pipe being used, another section of drill pipe is coupled to the first and the operation proceeds as before. As the hole attains a great depth, the rotative effort to the drill bit is transmitted by a very long pipe composed of a number of sections coupled together. If it should be necessary to replace the drill bit, the entire assembly of drill pipe must be pulled up out of the hole and uncoupled, section by section, and when a new drill bit has been attached, the entire process is reversed until the drill bit again reaches the bottom of the hole. This is a very tedious and time consuming operation. Specific attachment designs for motors comprising a helical gear pair, used as a down-hole motor, were taught in Clark U.S. Pat. No. 2,893,693, dated July 7, 1959.

Figure 3:
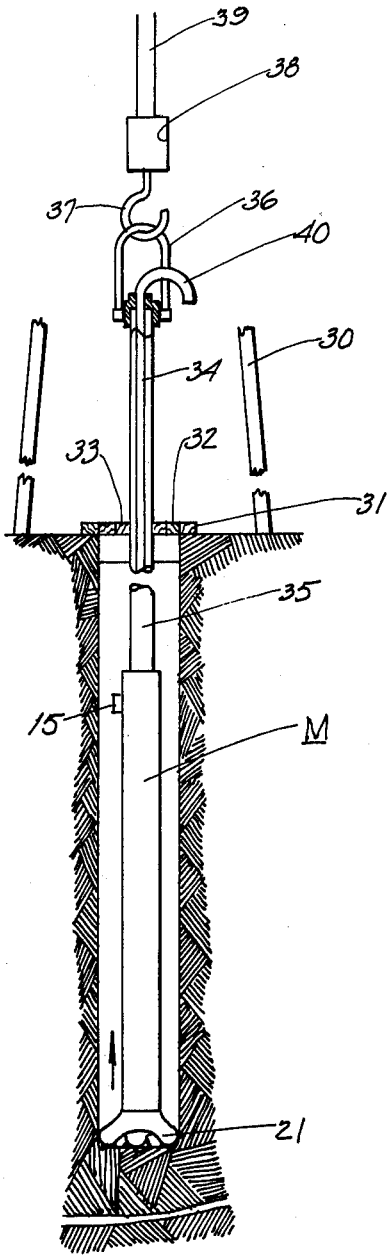
FIG. 3 is a somewhat diagrammatic representation of the use of the tool of the present invention in drilling with the use of a kelly and a stationary kelly bushing.

The tool disclosed in FIGS. 1 and 2 is very versatile and may be used in a number of different ways. In FIG. 3, the motor is shown in use in drilling a hole for a well or the like. A conventional derrick is diagrammatically shown at 30. On the floor of the rig is provided the so-called rotary table comprising a stationary portion 31, a rotating portion 32, and a kelly bushing 33. A polygonal kelly 34 is shown passing through the kelly bushing. A string of drill pipe 35 is attached to the end of the kelly and the fluid motor according to either FIG. 1 or FIG. 2 is attached to the end of the string 35. The tool 21 is threaded into the lower end of the motor M.

The kelly is provided with suspension means 36 and the suspension means is suspended from a hook 37 attached to the traveling block 38 connected by the cables 39 to the conventional hoisting mechanism (not shown). A fluid supply connection 40 is provided through which drilling mud may be pumped through the kelly and the drill pipe to the motor M.

Figure 4:
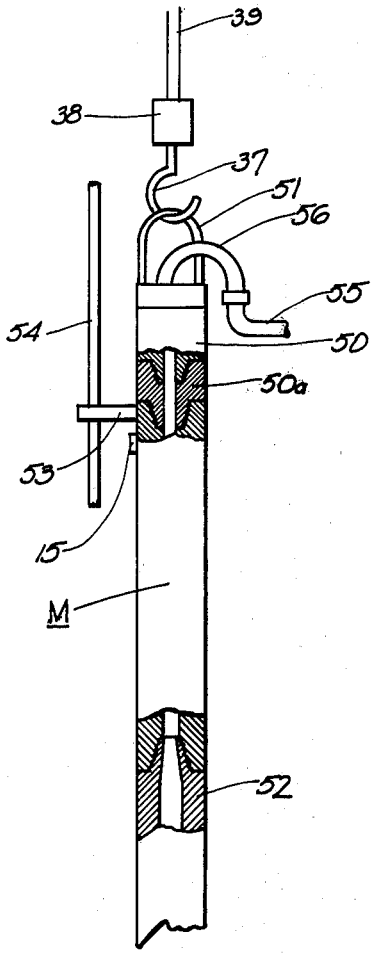
FIG. 4 is a more or less diagrammatic view of the use of a tool according to the present invention with a torque arm and a taut wire line, in the nature of a power swivel.

FIG. 4 shows the fluid motor of either FIG. 1 or FIG. 2 (preferably FIG. 2) hanging from the hook of the derrick of a conventional drilling rig and performing the function of a "power swivel". A conventional water swivel is provided at 50 which is hung from the hook 37 by means of the bail 51 and the hook 37 is attached to the traveling block 38 and cable 39 as in FIG. 3. The motor is threaded into the lower end of the water swivel 50 with a sub 50*a* having a left hand box up and a right hand pin down, as shown in FIG. 4, to accommodate conventional water swivel left hand threads, and the drill stem 52 is threaded into the lower end of the motor. In this case, the embodiment of FIG. 2 is shown and a torque arm 53 is secured to what in FIG. 2 is designated as the portion 14 of the water swivel 12. The torque arm 53 engages a taut wire line 54 along which it can slide so that the stationary part of the motor M is prevented from rotation but can move up and down along the cable 54. The use of a power swivel in drilling can eliminate the use of a kelly and rotary table during drilling.

It is, of course, also possible to furnish the device of FIG. 2 purely as a power swivel, by substituting for the part 14 of the water swivel of FIG. 2 a conventional part having a standard gooseneck intake instead of the axial intake shown. Such substitute part would be provided with the torque arm 53 and suspension means 51. Thus the regular water swivel 50 hanging on the derrick would be eliminated.

The embodiment of FIG. 4 has the advantage of eliminating the need for a separate power supply as is usually necessary with a power swivel. The drilling mud is supplied through the hose 55 and gooseneck 56 and thus the usual supplementary pump and hydraulic lines are eliminated and the power supply comes from the regular mud pump which must be in use at all times when drilling.

Figure 5:
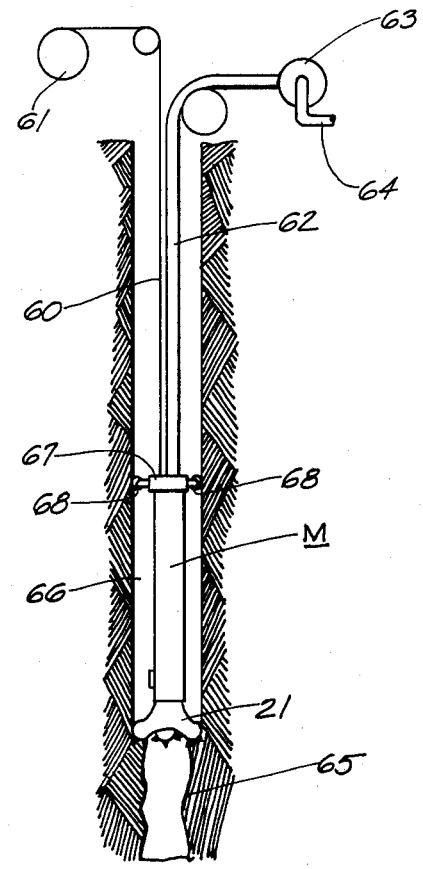
FIG. 5 is a diagrammatic view of the use of the tool together with rotation preventing means with the tool suspended from a wire line used in light clean-out operations.
Figure 6:
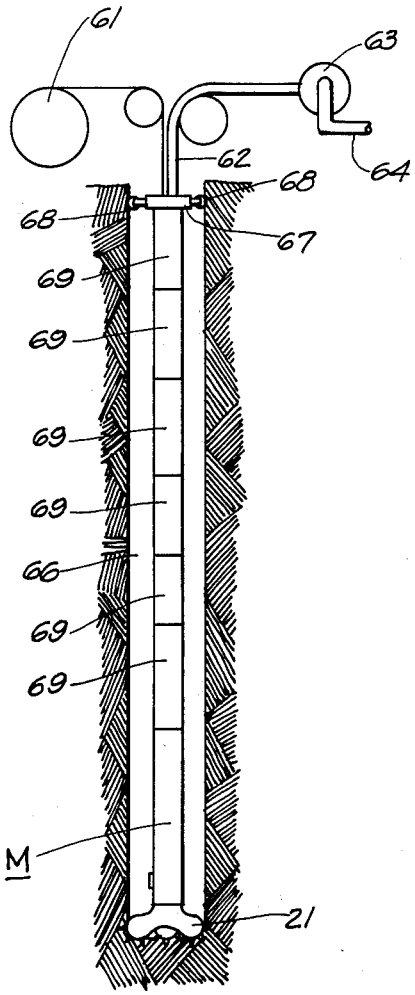
FIG. 6 is a view similar to FIG. 5 showing the tool used for boring.

In FIGS. 5 and 6, there is illustrated how the fluid motor of the present invention can be used for clean-out operations or for drilling without the use of drill pipe. In FIG. 5 the motor M, which may be either in the configuration of FIG. 1 or that of FIG. 2, is suspended by a wire line 60 controlled by a powered wire line reel 61. A hose 62 supplies drilling mud by means of a hose reel 63 and a hose providing a fluid intake at 64. In FIG. 5, the bore below the tool 21 indicated at 65 is rough, whereas above the tool 21 at 66 it is smooth. In this particular embodiment, the tool is being used for light clean-out work.

In order to prevent the element of the tool which is to be the fixed one (depending upon which way up the tool is employed) use is made of a device indicated generally at 67 which is described in detail in U.S. Patent No. 3,603,407 and is illustrated particularly in FIG. 10. Actually it comprises a pair of opposed cylinders with pistons therein which are subject to the pressure of the drilling mud supplied through the hose 62. This pressure forces the pistons outwardly and on the ends of the pistons rollers are provided as indicated at 68. These rollers permit the tool to ride up and down in the bore 66 but prevent the tool from rotating in the bore.

In FIG. 6 somewhat the same arrangement is shown for drilling purposes. In this embodiment, a plurality of drill collars 69 are used as required to provide appropriate weight on the bit 21. Again rotation is prevented by the device 67 described in connection with FIG. 5.

From the foregoing it will be seen that the fluid motor of FIGS. 1 and 2 is a very versatile device in that it can be used either end up, and it can be used for coring, milling or drilling, for light clean-out work, for drilling, milling or coring without drill pipe, and for use with a kelly which is fixed against rotation and in various other ways which will suggest themselves to those skilled in the art.

Depending upon which way up the motor is used, the outer member may be caused to rotate and drive the tool or the inner member may be caused to rotate and drive the tool. In directional drilling wherein the bore is changed in direction at some point, the operator would probably prefer that the outer element be non-rotating. On the other hand, in coring and diamond driling where a smooth tool free from vibration is desired, the flywheel effect of the heavy outer member rotating would be very desirable. This would also be true where the rock being drilled is a broken conglomerate or fractured strata which imparts variable shock to the system and causes excess strain on the motor and other parts of the drill stem, and here the flywheel effect would be particularly advantageous. If additional flywheel effect is desired, it can be provided by adding drill collars below the motor, with the boring or cutting tool attached thereon.

On the other hand, in smooth drilling there is no need to swing the excessive extra weight of the outer member and it would be desirable to change to the unit with the outer member stationary.

The device of the present invention also has advantages in improving the sub-sea wire line coring and drilling possibilities if used as depicted in FIGS. 8 and 9 of said U.S. Pat. No. 3,603,407, by eliminating inherent vibration, and by the elimination of bearings which were not grease packed, as is the case with the water swivel bearings in the motor of the present invention.

It will be clear that numerous changes may be made without departing from the spirit of the invention. No limitation not specifically set forth in the claims is intended or should be implied.

the embodiments of the invention in which an exclusive property or privilege is claimed are defined as follows:

1. A fluid motor comprising a helical gear pair constituted by an inner member having an external helical thread, and a cooperating outer member having one more internal helical thread than the number of external helical threads on said inner member, a tubular casing, the outer member of said gear pair being fixed in said casing, a water swivel having an axial intake, said casing being secured to one of the relatively rotatable sections of said water swivel, and means associated with an end of said inner member and with the other relatively rotatable section of said water swivel to prevent rotation while permitting gyration of said inner member relative to said outer member, and a tapered thread at the end of said tubular casing, and a tapered thread at the end of said other relatively rotatable section of said water swivel.

2. A fluid motor according to claim 1, wherein said means comprise a radial arm fixed to one end of said inner member, said arm terminating in a ball, said other section of said water swivel having a radial tube of a diameter to accommodate said ball, whereby said inner member may gyrate with said ball reciprocating in said tube, but may not rotate with respect to said other section of said water swivel.

3. A fluid motor according to claim 1, wherein said helical gear pair has left hand threads, and said tubular casing is threaded onto the end of a conventional string of drill pipe, and a tool, such as a drill bit, is threaded onto said other section of said water swivel, so that when fluid is pumped through said motor the tool is rotated by said inner member.

4. A fluid motor according to claim 1, wherein said helical gear pair has right hand threads, and said other section of said water swivel is threaded onto the end of a string of drill pipe, and a tool, such as a drill bit, is threaded onto the other end of said tubular casing, so that when fluid is pumped through said motor, the tool is rotated by said outer member.

5. A motor according to claim 1 serving as a power swivel, a torque arm secured to one member of said motor, and a cable in sliding engagement with said torque arm, and a drill string and tool secured to the other member of said motor, whereby when fluid is supplied to said motor, the said other member of said motor rotates said drill string and tool, while the coaction between said torque arm and cable prevents rotation of said one member of said motor while permitting vertical movement thereof.

6. In combination with a motor according to claim 1, a device secured to one member of said motor and having rollers in engagement with the bore of a hole being cleaned out, said device having means to press said rollers against said bore, a tool connected to the other member of said motor, a wire line and powered wire line reel for suspending said motor and tool in said hole, and a hose and hose reel for supplying fluid under pressure to said motor, said device permitting said wire line reel to raise or lower said motor and tool while preventing rotation of said one member of said motor in said bore.

7. A drilling arrangement comprising a motor according to claim 1, a device secured to one member of said motor and having rollers in engagement with the bore of the hole being drilled, said device having means to press said rollers against said bore, at least one drill collar secured to the other member of said motor, a tool secured to said drill collar, a wire line and a powered wire line reel for suspending said motor and drill collar in said hole, and a hose and hose reel for supplying fluid under pressure to said motor, said device permitting said wire line reel to raise or lower said motor, drill collar and tool, while preventing rotation of the said one member of said motor in said bore.

8. A fluid motor according to claim 1, wherein said means comprise a radial arm non-rotatably secured at one of its ends to said inner member, said other section of said water swivel being provided with fixed means limiting the other end of said radial arm to reciprocating and oscillatory motion, whereby said inner member may gyrate with the other end of said radial arm reciprocating in said fixed means, but may not rotate with respect to said other section of said water swivel.

9. In combination, for driving a drill bit, a fluid motor and a water swivel, said fluid motor comprising a helical gear pair including an inner member having an external helical thread and a corresponding outer member having one more internal helical thread than the number of external helical threads on said inner member, said water swivel having an axial intake and two relatively rotatable sections, said outer member being secured to one of the sections of the water swivel, and means for preventing rotation of said inner member while permitting gyration of said inner member relative to said outer member, said limiting means including a radial arm fixed to one end of said inner member, said arm terminating in a ball, said other section of said water swivel having a radial tube receiving said ball for reciprocation and oscillation.

* * * * *

UNITED STATES PATENT AND TRADEMARK OFFICE

CERTIFICATE OF CORRECTION

PATENT NO. : 4,051,910

DATED : October 4, 1977

INVENTOR(S) : WALLACE CLARK

It is certified that error appears in the above-identified patent and that said Letters Patent are hereby corrected as shown below:

In the ABSTRACT, line 2, the word "chamber" should be -- member --.

Column 3, line 12, after "joints" insert -- had --.

Column 2, line 18, "and" should be -- end --.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*